United States Patent [19]

Preputnick

[11] Patent Number: 4,715,829

[45] Date of Patent: Dec. 29, 1987

[54] HIGH DENSITY ELECTRICAL CONNECTOR SYSTEM

[75] Inventor: George Preputnick, Harrisburg, Pa.

[73] Assignee: AMP Incorporated, Harrisburg, Pa.

[21] Appl. No.: 930,587

[22] Filed: Nov. 13, 1986

[51] Int. Cl.[4] ..... H01R 13/04

[52] U.S. Cl. ..... 439/660; 439/485

[58] Field of Search ..... 339/17 LC, 112 R, 143 R, 339/176 R, 176 M, 176 MP

[56] References Cited

U.S. PATENT DOCUMENTS

| | | | |
|---|---|---|---|
| 3,149,265 | 9/1964 | Thorn | 339/112 R |
| 3,413,594 | 11/1968 | Fernald et al. | 339/176 MP |
| 3,634,816 | 1/1972 | Zell | 339/17 LC |
| 4,392,705 | 7/1983 | Andrews, Jr. et al. | 339/75 MP |
| 4,518,209 | 5/1985 | Negley | 339/17 LC |
| 4,521,062 | 6/1985 | Kurbikoff et al. | 339/17 LC |

OTHER PUBLICATIONS

AMP Incorporated Data Sheet 80–566 "Eurocard Connectors".

*Primary Examiner*—Joseph H. McGlynn
*Attorney, Agent, or Firm*—Allan B. Osborne

[57] ABSTRACT

A high density electrical connector system for electrically interconnecting circuits on two or three printed circuit devices. More particularly, the connector system includes matable pin and receptacle connectors with the pin connector mounted on one printed circuit device and the receptacle connector having mounting ears for receiving a heat sink with printed circuit devices attached to one or two opposing surfaces.

8 Claims, 16 Drawing Figures

HIGH DENSITY ELECTRICAL CONNECTOR SYSTEM

FIELD OF THE INVENTION

The invention disclosed herein relates to a high density connector system which includes a pair of matable connectors, one being a pin connector for mounting on one printed circuit device such as a backplane and the second being a receptacle connector which mates with the pin connector and has thereon a pair of printed circuit devices such as circuit cards with a heat sink sandwiched therebetween.

BACKGROUND OF THE INVENTION

Two piece interconnect or matable connectors are well known in the art as exemplified by the Eurocard system which includes a pin connector mounted on the one printed circuit device and a receptacle connector mounted on a second printed circuit device and which mates with the pin assembly to electrically interconnect the two circuit devices. The contact elements in the pin and receptacle contacts are positioned in rows on one hundred (0.100) inch (2.54 cm) center lines; e.g., a system having ninety-six contact elements in housings 3.74 inches long (95 cm) would have three rows of thirty-two elements each. To increase the density of I/Os, additional rows of contact elements are added and/or the rows are made longer. This, of course, takes more space on the circuit devices which is objectionable in some situations.

It is now proposed to provide a high density electrical connector system to achieve higher density I/Os without sacrificing circuit devices real estate.

SUMMARY OF THE INVENTION

According to the invention, a high density electrical connector system is provided which includes a pin connector for mounting on a printed circuit device and which receives a receptacle connector on which is mounted a heat sink with one or two printed circuit devices attached to one or two opposing surfaces. Pin members, insert molded in a module of dielectric material, include one end for electrically engaging circuits on the one printed circuit device and another end for electrically mating with receptacles on contact elements located in passages in a module of dielectric material of the receptacle connector. Cantilever beams, extending outwardly from attachment with the receptacles on the contact elements, electrically engage circuits on other printed circuit devices attached to the heat sink.

DESCRIPTION OF THE INVENTION

Figure 1:
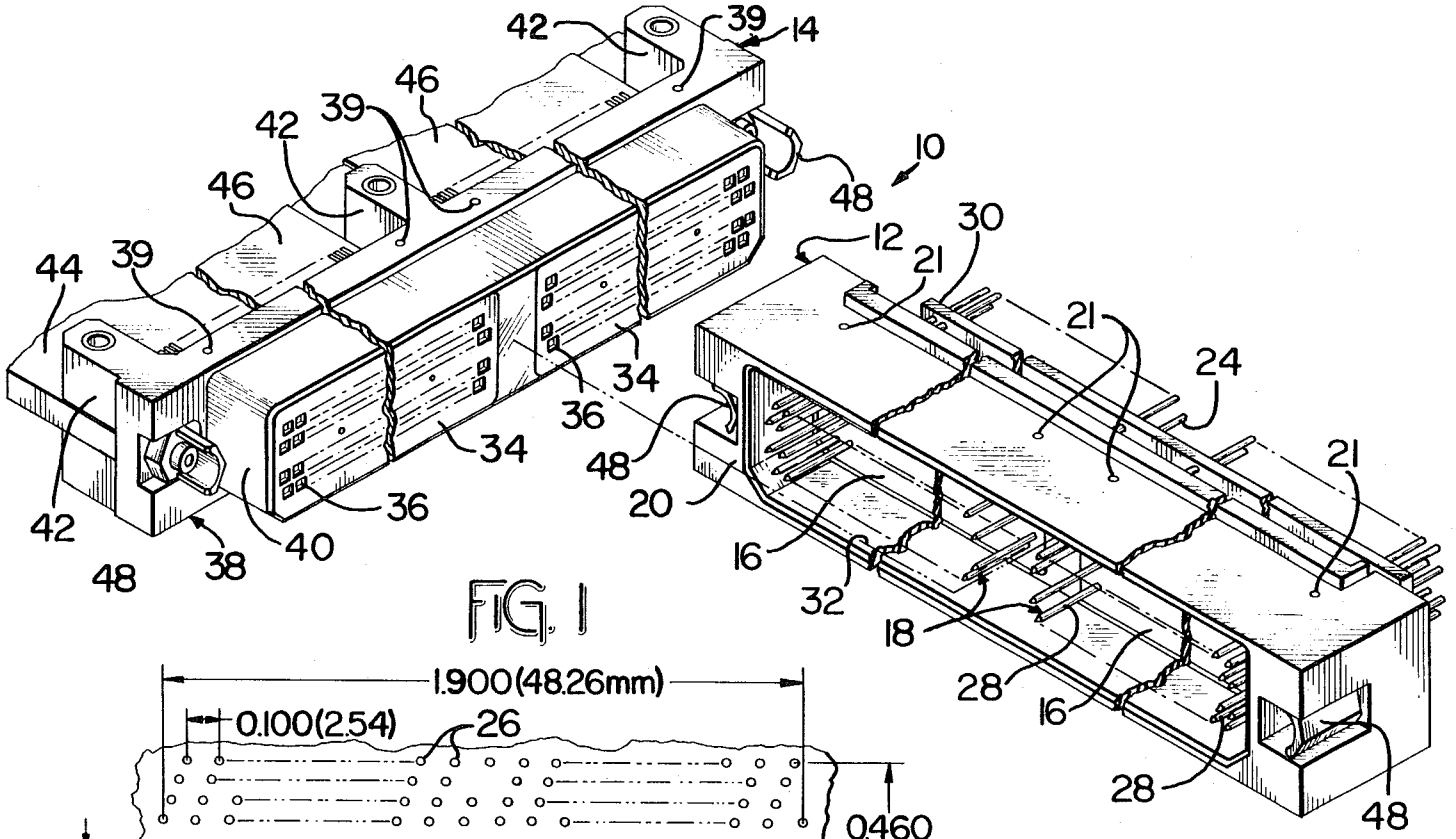
FIG. 1 is a perspective view of the pin and receptacle connectors of the high density electrical connector system of the present invention.

The high density electrical connector system 10 of the present invention includes, as shown in FIG. 1, pin connector 12 and receptacle connector 14. Pin connector 12 includes modules 16 of contact pin members 18 housed in metal shell 20 and retained therein by spiral pins 21. Connector 12 is mounted on a printed circuit device 22 such as the segment shown in FIG. 2. Pin members 18, described more fully below, include posts 24 which are inserted into holes 26 in device 22 and mating ends 28 which are received in receptacle connector 14. Post straightener strip 30, having a hole pattern identical to that shown on device 22, may be positioned on posts 24 to straighten any that are out of line and maintain them in the pattern for ease in inserting them into holes 26. Mating ends 28 are within cavity 32 in shell 20. As shown, the outline of cavity 32 includes two rounded and two beveled corners. Circuit device 22 may be a backplane, mother board or other like device.

Shell 20 is preferably made from aluminum and anodized to provide ruggedness and RF shielding.

Receptacle connector 14 includes modules 34 of receptacle contact elements 36 housed in metal shell 38 and retained therein by means of spirol pins 39. Projection 40 on one side of connector 14 is received in cavity 32 in pin connector 12 and has rounded and beveled corners for polarized insertion thereinto. Pairs of spaced apart mounting ears 42, projecting outwardly from an opposite side of connector 14 receives and supports heat sink 44 on which two printed circuit devices 46 are mounted on opposite surfaces thereof. Devices 46 may be circuit cards or the like.

Conventional keys 48 on both connectors 12, 14 provide means for insuring that pre-determined connectors 12, 14 are mated together.

Figure 2:
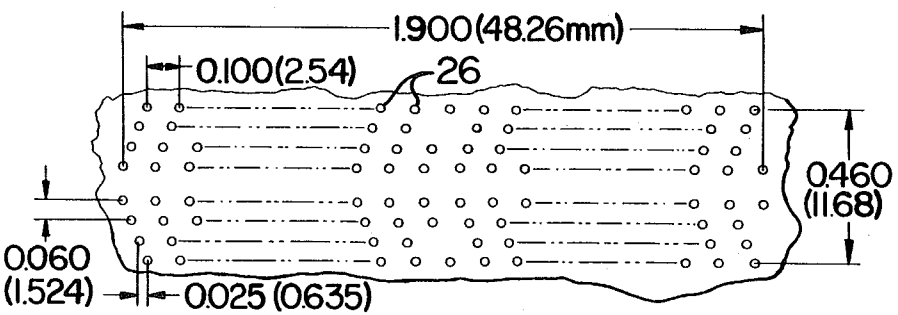
FIG. 2 is a plan view of the hole pattern in a printed circuit device on which the pin connector is mounted.

Holes 26 in device 22 are in a close pattern with the spacing therebetween shown in FIG. 2. The pattern provides a total of 76 holes 26 over a length of 1.900 inches (48.26 mm) and a width of 0.460 inches (11.68 mm). Four rows of holes 26 are provided with adjacent holes in each row being on 0.100 (2.54 mm) inch center lines. Rows are spaced apart 0.060 (1.52 mm) inches center to center and are staggered or displaced 0.025 (0.635 mm) inches relative to each other to form overall a chevron or arrowhead shape.

Figure 3A:
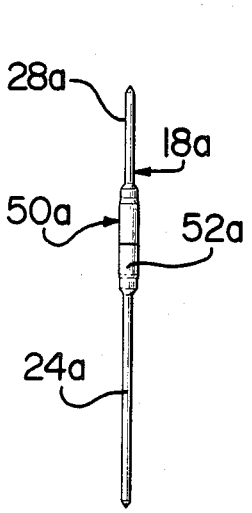
FIGS. 3A and 3B are plan views of the two contact pin members of the pin connector.
Figure 3B:
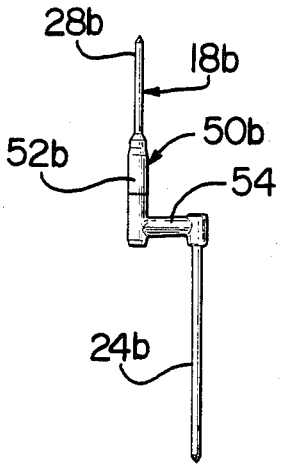
Figure 4A:
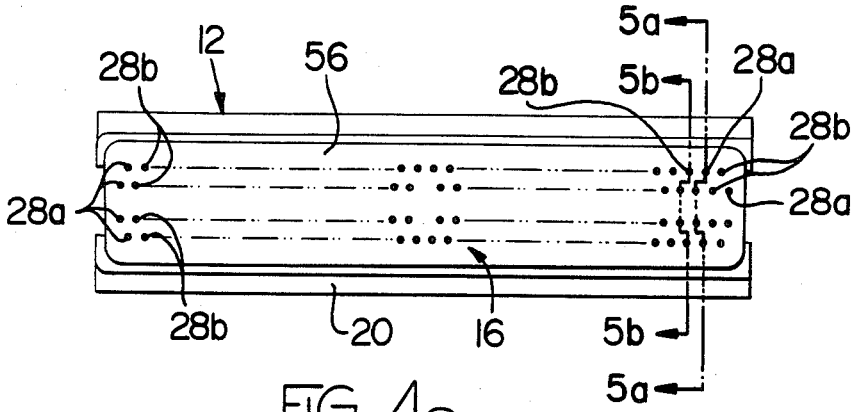
FIGS. 4A, 4B and 4C are top plan, side elevational and bottom plan views of the pin connector.
Figure 4B:
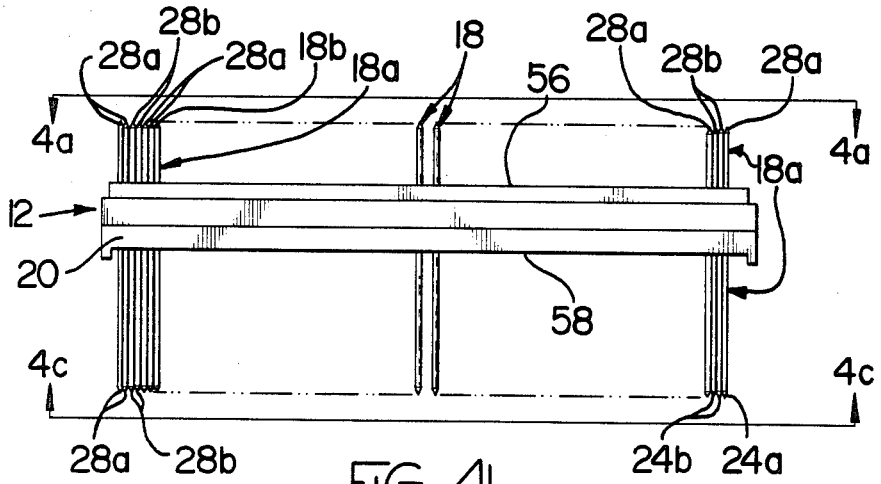

Contact pin members 18 include members 18A, shown in FIG. 3A, and members 18B, shown in FIG. 3B. Both members 18A, 18B include the previous mentioned posts 24 and mating ends 28. The differ only in the intermediate sections 50A and 50B, the former being part of member 18A and the latter being part of member 18B. Section 50A includes retaining portion 52 which is greater in cross-section area than post 24 and mating end 28 to which section 50A is attached. As can be seen in FIGS. 3A and 4A, portion 52 is cylindrical.

Section 50B includes retaining portion 52 and strap portion 54 which is normal to the axis of contact 18B and offsets post 24 relative to mating end 28.

Pin members 18 are preferably stamped and formed with a suitable material being phos bronze.

Modules 16 are formed by insert molding pin members 18A, 18B in a dielectric material such as polyphenylene sulfide. As shown in FIG. 4A, a top plan view of connector 12, and FIG. 4C, a bottom plan view of connector 12, it can be seen that members 18 extend outwardly in different patterns. The pattern in top surface 56 of connector 12 consists of two rows on each side of the longitudinal center line of connector 12. Each row is displaced relative to the adjacent row by one half the distance between adjacent mating ends 28 which are on 0.050 inch (1.27 mm) centers. The rows on each side of the center line are on 0.060 inch centers and the space between centers of the outermost rows in 0.220 inches (5.59 mm). The pattern in bottom surface 58 is identical in all respects with the pattern of holes 26 in board 22 shown in FIG. 2; i.e., there are four rows on each side of the longitudinal center line of connector 12 with each row displaced to form the aforementioned chevron shape. The rows are on 0.060 inch (1.52 mm) centers and the space between centers of the extreme outer rows is 0.460 inches (11.68 mm).

Figure 5A:
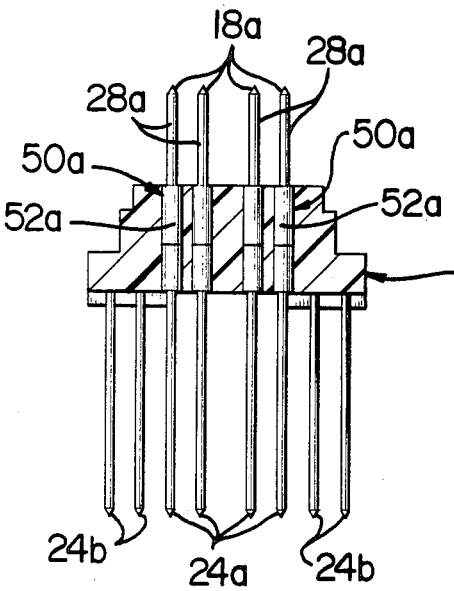
FIGS. 5A and 5B are cross-sectional views of the pin connector taken along lines 4A—4A and 4B—4B in FIGS. 5A and 5C.
Figure 5B:
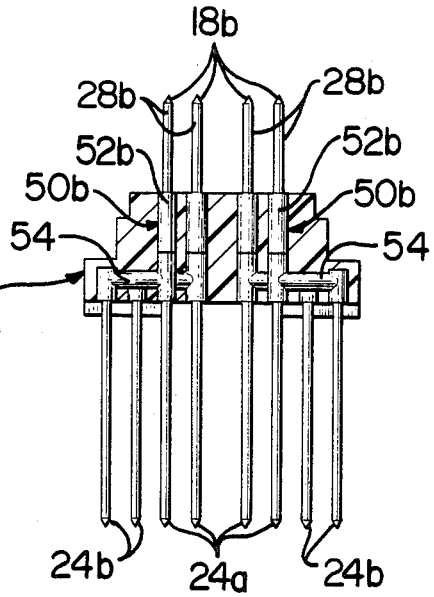
Figure 4C:
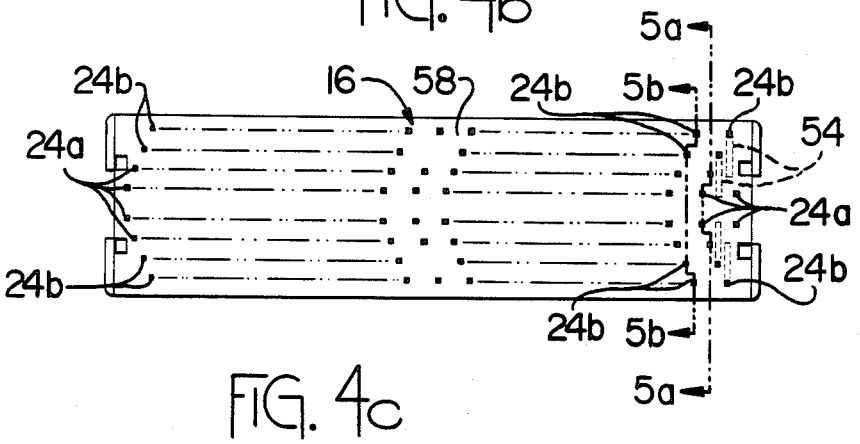

With respect to top surface 56 of connector 12, members 18 are positioned in modules 16 so that mating ends 28A on members 18A form a line across all four rows as indicated by line 5A—5A in FIG. 4A and mating ends 28B on members 18B form the adjacent line across all four rows as indicated by line 5B—5B. With respect to bottom surface 58 of connector 12, posts 24A on members 18A form the two inside rows on each side of the longitudinal center line of connector 12 and posts 24B on members 18B form the two outside rows on each side of the center line. Strap portions 54 of members 18B, shown in phantom in FIG. 4C, provide the inward shift of mating ends 28B to accommodate the narrower pattern on top surface 56. The cross-sectional views of connector 12 shown in FIGS. 5A and 5B clearly illustrate the arrangement of pin members 18A, 18B in modules 16.

Figure 6:
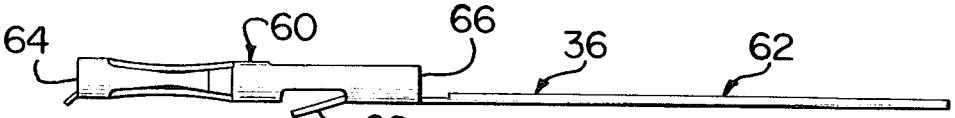
FIG. 6 is a view of the contact element of the receptacle connector.

As shown in FIG. 6, receptacle contact element 36 includes box receptacle 60 and cantilever beam 62 (shown unformed) attached thereto. Receptacle 60 includes passage 64, forward end 66 and retaining lance 68. A complete description of receptacle 60 may be found in U.S. Pat. No. 3,404,367 which is incorporated herein by reference.

Figure 7B:
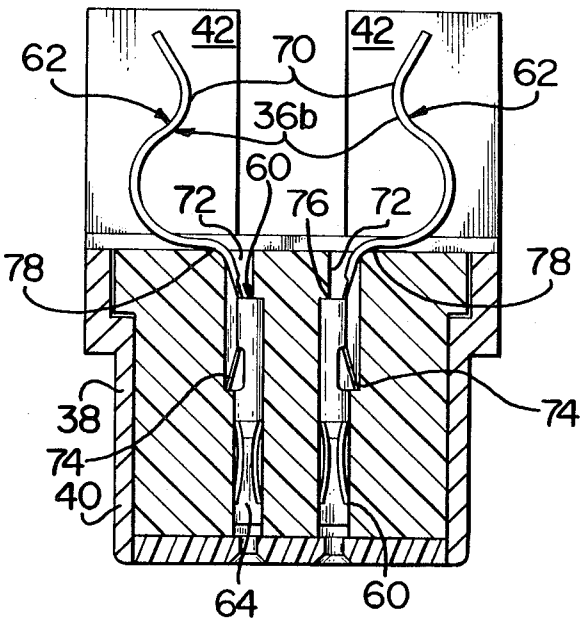
FIGS. 7A and 7B are cross-sectional views of the receptacle connector taken along lines 7A—7A and 7B—7B in FIG. 8.
Figure 7A:
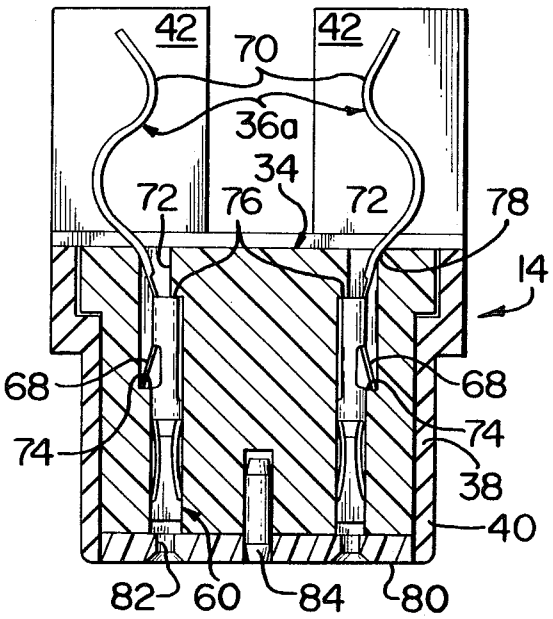

As shown in FIGS. 7A and 7B, cantilever beams 62 are formed into a curving shape to define a convex contact area 70 and further are displaced out of line with receptacle 60. On some elements, designated 36A, beams 62 are out of line with receptacle 60 to a lesser degree than on other elements, designated 36B, for a reason noted below.

Contact elements 36 are stamped and formed with beryllium copper being a suitable material.

Modules 34 are preferably molded with polyphenylene sulfide being a suitable material. As shown in FIG. 1, each module 34 is shaped to occupy one half of shell projection 40 and is provided with four rows of passages 72 in a pattern identical to that described above with respect to the pattern defined by mating ends 28 extending outwardly from connector 12 and shown in FIG. 4A.

With reference to FIG. 7A and 7B, passages 72 include a pair of spaced apart, inwardly facing shoulders 74, 76 intermediate the openings thereto. Further, a portion of the edge of one opening is rounded as indicated by reference number 78.

As shown in FIGS. 7A and 7B, contact elements 36A are positioned in the two outermost row of passages 72 and contact elements 36B are positioned in the two innermost rows of passages 72 with beams 62 bearing against rounded edge portions 78. Because of the differential displacement of beams 62 mentioned above, the convex contact areas 70 are in line with each other both on the vertical and horizontal planes. Retention of contact elements 36 in passages 72 is obtained by forward ends 66 abutting shoulders 76 and lances 68 engaging shoulders 74.

Figure 8:
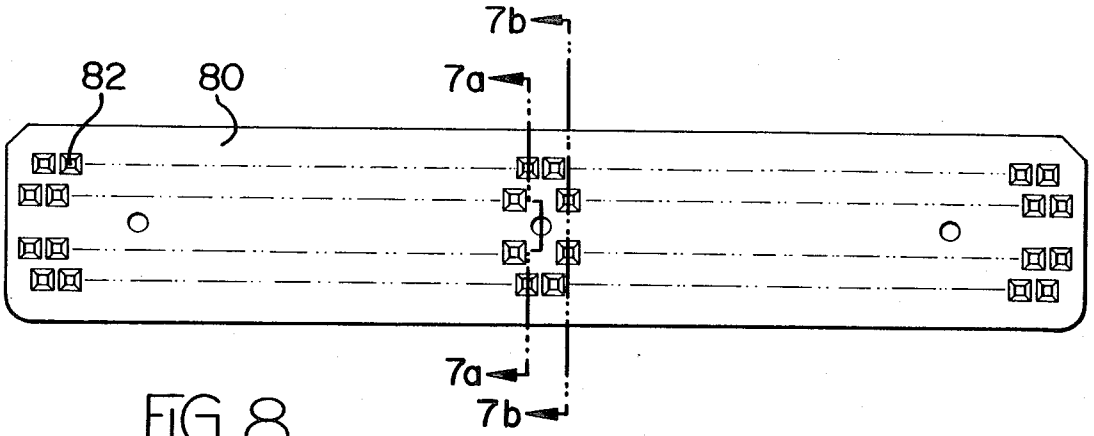
FIG. 8 is a plan view of the cover of the receptacle connector.

As shown, modules 34 include a separate cover 80. Cover 80, shown in plan view in FIG. 8, is provided with four rows of openings 82 arranged in the same pattern as passages 72 in modules 34. As more clearly shown in FIGS. 7A and 7B, openings 82 in cover 80 include a funnel portion to guide mating ends 28 into box receptacles 60 on elements 36. Spiral pins 84 secure cover 80 to module 34.

Figure 9:
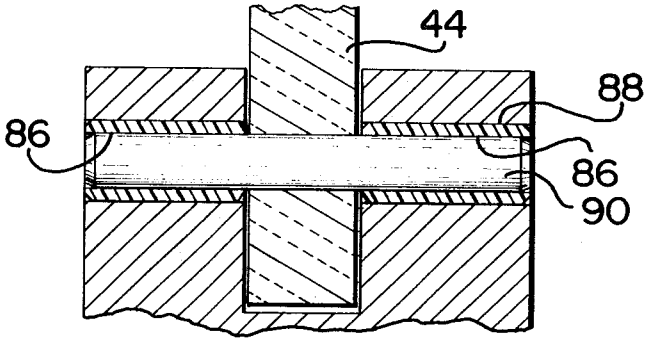
FIG. 9 is a cross-sectional view of the arrangement for mounting a pair of printed circuit devices with a heat sink therebetween onto the receptacle connector.

As noted above, mounting ears 42 on connector 14 receives and supports heat sink 44. FIG. 9 illustrates the details of the support. Bushings 86 are press fit into holes 88 in each ear 42 and then removed to receive roll pin 90 which extends through both ears 42 and through heat sink 44 which is positioned in the space therebetween. The above-described support allows heat sink 44 to float.

Figure 10:
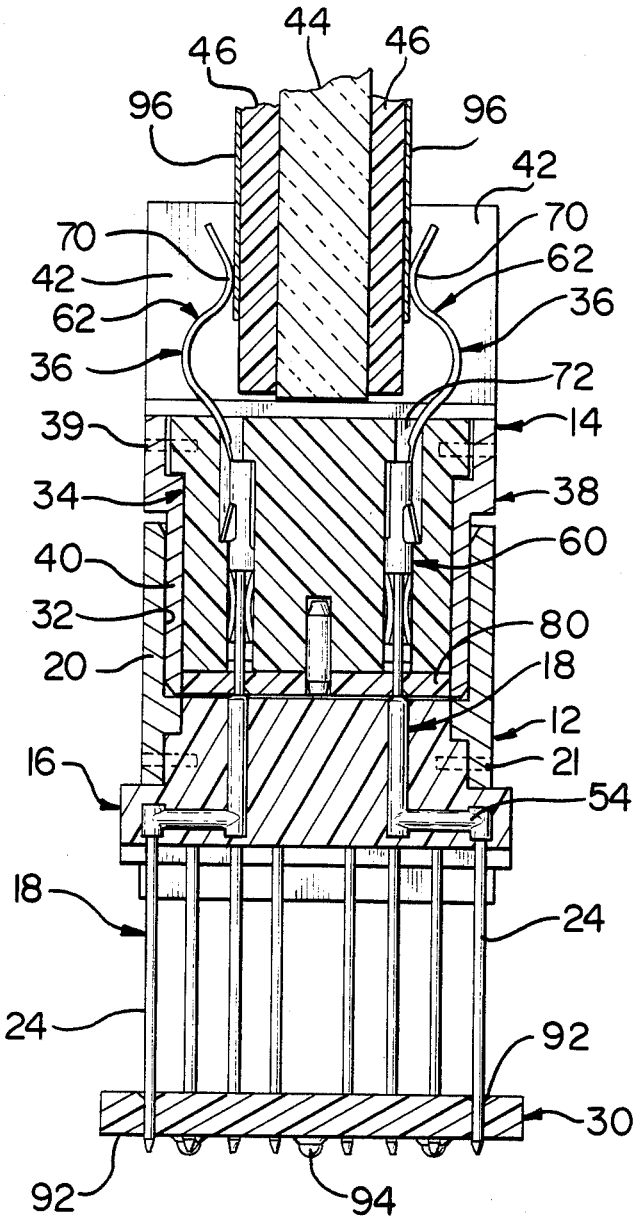
FIG. 10 is a cross-sectional end view of the pin and receptacle connectors mated together.

FIG. 10 is a view of pin connector 12 and receptacle connector 14 joined together with projection 40 on shell 38 of connector 14 in cavity 32 and mating ends 28 of pin members 28 in connector 12 received in passages 64 in box receptacles 60 on contact elements 36.

Post strip 30, molded from a dielectric material, is shown in FIG. 10 in substantially more detail than in FIG. 1. A plurality of openings 92 extend therethrough in an arrangement identical to the pattern of posts 24 extending outwardly from connector 12. Further, strip 30 includes stand-off knobs 94 on one surface thereof to engage device 22 when connector 12 is mounted thereon. As is known in the art, strip 30 maintains posts 24 in proper alignment for insertion into holes 26 in device 22. Knobs 94 hold connector 12 away from the device for reflow soldering and subsequent washing.

FIG. 10 also shows heat sink 44, with circuit devices 46 attached to each side thereof, mounted on receptacle connector 14 and with convex contact areas 70 on contact elements 36 engaging conductive traces 96 on devices 46.

As can be discerned, a high density, electrical connector system has been disclosed. The system includes a pair of matable first and second connectors having electrically engaging conductive pin members and contact elements respectively. The first connector is for being mounted on one circuit device and the second connector has mounted thereon a heat sink with circuit devices, on opposing surfaces which are electrically engaged by cantilever beams on the contact elements in the second connector. The heat sink is retained by roll pins supported in reamed bushings located in outwardly extending ears on the second connector. The pin members are molded in modules and assembled in a metal shell. The contact elements are positioned in passages in modules which are also positioned in a metal shell to define the second chamber. Pin members having longitudinally offset posts and mating ends permit close spacing between members and higher densities.

I claim:

1. A high density electrical connector system for electrically interconnecting circuits on printed circuit devices such as backplane, mother boards. daughter cards and the like, said system comprising:

first connector means having dielectric module means housed in shell means and a plurality of conductive pin members contained in said module means with first and second ends thereof extending outwardly from opposite sides of said module means with said first ends adapted to engage circuits on a printed circuit device;

second connector means having dielectric module means with a plurality conductive contact elements contained therein, said elements having receptacle means at one end for receiving said second ends of said pin members and outwardly extending cantilever beam means at another end for electrically engaging circuits on another printed circuit device so that the two devices may be electrically interconnected;

shell means housing said module means of said second connector means, said shell means having a pair of spaced apart ears for receiving a heat sink; and pins, received in each of said pairs of ears, extending through and supporting the heat sink.

2. The high density electrical connector system according to claim 1 wherein said pins are received in bushings press-fit in each of said ears.

3. The high density electrical connector system according to claim 1 wherein printed circuit devices are attached to opposing surfaces of the heat sink and said cantilever beam means extend outwardly from said module means in two rows with a space therebetween to receive the heat sink and printed circuit devices attached thereto.

4. The high density electrical connector system according to claim 1 wherein some of said pin members of said first connector means include displacing means so that the first and second ends are not coaxial.

5. The high density electrical connector system according to claim 4 wherein the first ends are on a different pattern and spacing than the second ends.

6. The high density electrical connector system according to claim 5 wherein the pattern defined by said first ends is chevron-shaped.

7. The high density electrical connector system according to claim 1 wherein the passages in said module means of said second connector means are arranged in sets of two rows each on each side of the longitudinal center of said module means with said rows of passages in each set being longitudinally displaced relative to each other.

8. The high density electrical connector system according to claim 7 wherein said cantilever beam means on said contact elements disposed in the outermost rows of passages extend outwardly from said module means at a different angle relative to the cantilever beam means on said contact elements disposed in the innermost rows of passages and with the convex contact areas on all cantilever beam means being located at the same horizontal and vertical planes relative to said module means.

* * * * *